US011312462B1

(12) United States Patent
Faust et al.

(10) Patent No.: US 11,312,462 B1
(45) Date of Patent: Apr. 26, 2022

(54) COWLINGS FOR MARINE DRIVES AND LATCHING DEVICES FOR COWLINGS FOR MARINE DRIVES

(71) Applicant: Brunswick Corporation, Mettawa, IL (US)

(72) Inventors: Devan R. Faust, Fond du Lac, WI (US); Brad J. VanRuiswyk, Waupun, WI (US); Steven J. Amerling, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 16/986,938

(22) Filed: Aug. 6, 2020

(51) Int. Cl.
*B63H 20/32* (2006.01)

(52) U.S. Cl.
CPC ..... *B63H 20/32* (2013.01)

(58) Field of Classification Search
CPC ..... B63H 20/32
See application file for complete search history.

(56) References Cited

U.S. PATENT DOCUMENTS

| | | | |
|---|---|---|---|
| 3,955,526 | A | 5/1976 | Kusche |
| 4,216,984 | A | 8/1980 | Hofmann et al. |
| 4,348,194 | A | 9/1982 | Walsh |
| 4,385,341 | A | 5/1983 | Main |
| 4,600,396 | A | 7/1986 | Crane et al. |
| 4,723,927 | A | 2/1988 | Walsh et al. |
| 4,800,854 | A | 1/1989 | Boda et al. |
| 4,844,031 | A | 7/1989 | Boda et al. |
| 4,871,333 | A | 10/1989 | Curtis et al. |
| 4,875,883 | A | 10/1989 | Slattery |
| 4,878,468 | A | 11/1989 | Boda et al. |
| 4,886,942 | A | 12/1989 | Lenz et al. |
| 4,930,790 | A | 6/1990 | Sheridan |
| 4,932,909 | A | 6/1990 | Curtis et al. |
| 4,969,847 | A | 11/1990 | Curtis et al. |
| 5,120,248 | A | 6/1992 | Daleiden et al. |
| 5,344,338 | A | 9/1994 | Colleran et al. |
| 5,600,885 | A | 2/1997 | Schroepfer et al. |
| 6,669,517 | B1 | 12/2003 | Alby et al. |

(Continued)

OTHER PUBLICATIONS

Declaration of Prior Art submitted in corresponding U.S. Appl. No. 16/986,669, dated Aug. 6, 2020.

(Continued)

*Primary Examiner* — Stephen P Avila
(74) *Attorney, Agent, or Firm* — Andrus Intellectual Property Law, LLP

(57) ABSTRACT

A cowling is for a marine drive. The cowling has first and second cowl portions for enclosing a powerhead, and a latching device which is movable into a latched position in which the powerhead is enclosed by the first cowl and second cowl portions and an unlatched position in which the second cowl portion is movable with respect to the first cowl portion so that the powerhead is accessible. The latching device has an electric actuator configured to automatically move the latching device from the latched position to the unlatched position and a manually-operable input device which is accessible from outside of the cowling and is configured to actuate the electric actuator to thereby automatically move the latching device from the latched position to the unlatched position.

28 Claims, 11 Drawing Sheets

(56) References Cited

U.S. PATENT DOCUMENTS

| | | | | |
|---|---|---|---|---|
| 6,682,379 | B1 | 1/2004 | Walczak et al. | |
| 6,991,500 | B1 | 1/2006 | Gulko et al. | |
| 7,201,623 | B1 | 4/2007 | Krupp et al. | |
| 7,267,592 | B1 | 9/2007 | Ingebritson et al. | |
| 9,216,805 | B1 | 12/2015 | Amerling et al. | |
| 9,341,008 | B1 | 5/2016 | Amerling et al. | |
| 9,481,438 | B1 | 11/2016 | Tuchscherer | |
| 9,580,943 | B1 | 2/2017 | Amerling et al. | |
| 9,580,947 | B1 | 2/2017 | Amerling et al. | |
| 9,926,064 | B1 | 3/2018 | Tuchscherer | |
| 10,005,534 | B1 | 6/2018 | Amerling et al. | |
| 10,150,549 | B1 | 12/2018 | Amerling et al. | |
| 10,161,168 | B1 * | 12/2018 | VanRuiswyk | B63H 20/32 |
| 2005/0098413 | A1 * | 5/2005 | Uehira | H01H 61/0107 200/5 R |
| 2007/0249244 | A1 * | 10/2007 | Watanabe | B63H 21/213 440/84 |
| 2015/0047897 | A1 | 2/2015 | Zimet et al. | |
| 2016/0190731 | A1 | 6/2016 | Ting et al. | |
| 2016/0201776 | A1 * | 7/2016 | Takase | B63H 20/12 74/89.23 |

OTHER PUBLICATIONS

Southco Latch model No. R4-50-40-1 01-10, retrieved from https://southco.com/en_us_int/r4-50-40-101-10, on Dec. 15, 2021.

Mercury Marine, FourStroke 75-150hp, retrieved from https://www.mercurymarine.com/en/us/engines/outboard/fourstroke/75-150hp/, on Dec. 15, 2021.

Mercury Marine, Electronic Parts Catalog, Top Cowl Cat.# 90-8M0087973, retrieved from https://public-mercurymarine.sysonline.com/Default.aspx? sysname=NorthAmerica&company=Guest&NA_Key=NA_KEY_VALUE&langIF=eng&langDB=eng, on Dec. 15, 2021.

Declaration of Prior Art signed by the inventor, Devan R. Faust, on Dec. 16, 2021.

* cited by examiner

COWLINGS FOR MARINE DRIVES AND LATCHING DEVICES FOR COWLINGS FOR MARINE DRIVES

FIELD

The present disclosure relates to cowlings for marine drives, and more particularly to cowlings for marine drives and to latching devices for cowlings for marine drives.

BACKGROUND

It is known to use single pawl latches to hold a cowl onto a marine engine. The following U.S. Patents are also incorporated herein by reference:

U.S. Pat. No. 10,161,168 discloses a latching assembly for a cowl on a marine drive, the cowl having a first cowl portion and a second cowl portion that mates with the first cowl portion. A latching device is configured to latch and unlatch the first cowl portion to the second cowl portion. An actuator actuates the latching device. A flexible connector has a first end coupled to the latching device and a second end coupled to the actuator. Actuation of the actuator pulls the flexible connector to rotate a pulley and actuate the latching device. One of the first and second ends has a spherical bearing that is nested in a cylindrical bearing and seated in a cavity in the pulley. Pulling on the flexible connector pulls the spherical bearing against the cylindrical bearing such that the cylindrical bearing is pulled against the cavity in the pulley, thereby causing the pulley to rotate.

U.S. Pat. No. 10,005,534 discloses an assembly for aligning and stabilizing first and second cowl portions on a marine engine. The assembly comprises an engagement member configured to be fixed to the first cowl portion and a retainer apparatus configured to be fixed to the second cowl portion. The retainer apparatus is configured to receive the engagement member when one of the first cowl portion and second cowl portion is moved towards the other of the first cowl portion and the second cowl portion. The retainer apparatus comprises a retainer body and opposing guide members that are pivotable with respect to the retainer body. As the retainer apparatus receives the engagement member, the engagement member engages and causes the guide members to pivot with respect to the retainer body such that the engagement member becomes sandwiched between the guide members, thus aligning and stabilizing the first and second cowl portions.

U.S. Pat. No. 9,926,064 discloses a latching apparatus for a cowl on an outboard marine engine. The cowl has a first cowl portion and a second cowl portion, which are latched together by the latching apparatus in a closed cowl position and unlatched from each other in an open cowl position. The latching apparatus comprises a retainer on the first cowl portion; an actuator device on the second cowl portion, and a wire coupled to the actuator device. The wire is coupled to the retainer in the closed cowl position and the wire is uncoupled from the retainer in the open cowl position. Actuation of the actuator device in a first direction rotates the wire so as to couple the wire to the retainer and actuation of the actuator device in a second direction rotates the wire so as to uncouple the wire from the retainer.

U.S. Pat. No. 9,580,947 discloses a cowl for an outboard marine propulsion device having an internal combustion engine. The cowl comprises a first cowl portion; a second cowl portion that mates with the first cowl portion to enclose the internal combustion engine; a service door on the second cowl portion, wherein the service door is positionable in an opened position and in a closed position; and a carrying handle on the second cowl portion, wherein the carrying handle is accessible when the service door is in the opened position and inaccessible when the service door is in the closed position. A plurality of latches are spaced apart around the perimeter. The latches latch the second cowl portion to the first cowl portion. An actuator assembly actuates each of the plurality of latches. The actuator assembly can be actuated by movement of the carrying handle.

U.S. Pat. No. 9,341,008 discloses a hinge assembly for a cowl of an outboard motor. The hinge assembly is configured to connect a first portion of the cowl to a second portion of the cowl. The hinge assembly comprises an arm that is connected to one of the first and second cowl portions and a retainer that is connected to the other of the first and second cowl portions. The arm is movable with respect to the retainer between a registered position wherein the arm is retained by and pivotable with respect to the retainer to thereby pivotably connect the first portion of the cowl to the second portion of the cowl and an unregistered position wherein the arm is separated from the retainer so that the first portion of the cowl is separated from the second portion of the cowl.

U.S. Pat. No. 7,267,592 discloses a latch mechanism for a cowl of an outboard motor provides a handle and retaining mechanism for the handle which define a detent position when the handle is in a latching or closed position. A protrusion of the handle rotates in a plane which places it between a roller and a metallic ball when the handle is in a latching position. The metallic ball is shaped to be received in a groove formed in the protrusion in order to define the detent position when the handle is in its latched position.

U.S. Pat. No. 4,969,847 discloses a strain relief assembly for an outboard motor for relieving strain on wires, cables, lines or the like which extend between the boat and the cowl assembly which encloses the power head of the outboard motor. The stain relief assembly is preferably disposed within an opening formed in one of the cowl sections, and comprises a two-piece member. The two-piece member comprises a series of indentations which cooperate to clamp the wires, cables, lines or the like there between when screwed together. With the strain relief assembly fixed to the wall of the cowl section forming the opening, this acts to maintain the wires, cables or lines in position relative to the cowl section for relieving strain thereon during movement of the outboard motor. A fuel line strain relief assembly is also provided, comprising a stem fixed to the two-piece member. An external fuel line supplies fuel to the stem, which is communicated there through to an internal fuel line extending between the stem and the power head.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

A cowling is for a marine drive. The cowling has first and second cowl portions for enclosing a powerhead and a latching device which is movable into a latched position in which the powerhead is enclosed by the first cowl and second cowl portions and an unlatched position in which the second cowl portion is movable with respect to the first cowl portion so that the powerhead is accessible. The latching device has an electric actuator configured to automatically move the latching device from the latched position to the unlatched position and a manually-operable input device which is accessible from outside of the cowling and is configured to actuate the electric actuator to thereby automatically move the latching device from the latched position to the unlatched position.

The latching device has a pawl mechanism on a first one of the first and second cowl portions and an engagement member on a second one of the first and second cowl portions. The pawl mechanism is movable by the electric actuator into and between a closed position for retaining the engagement member when the latching device is in the latched position and an opened position for releasing and receiving the engagement member when the latching device is in the unlatched position. The pawl mechanism comprises first and second pawl members that are rotatable about first and second pawl axes, respectively. The first and second pawl members in the closed position retain the engagement member there between and thus retain the first and second cowl portions together so as to enclose the powerhead. Alternately, the first and second pawl members are movable into the opened position so as to release the engagement member and thereby allow the first and second cowl portions to be separated from each other so the powerhead is accessible.

Various other features, objects, and advantages of the invention will be made apparent from the following description taken together with the drawings.

BRIEF DESCRIPTION OF THE DRAWINGS

The present disclosure refers to the following drawing Figures.

DETAILED DESCRIPTION

Figure 1:
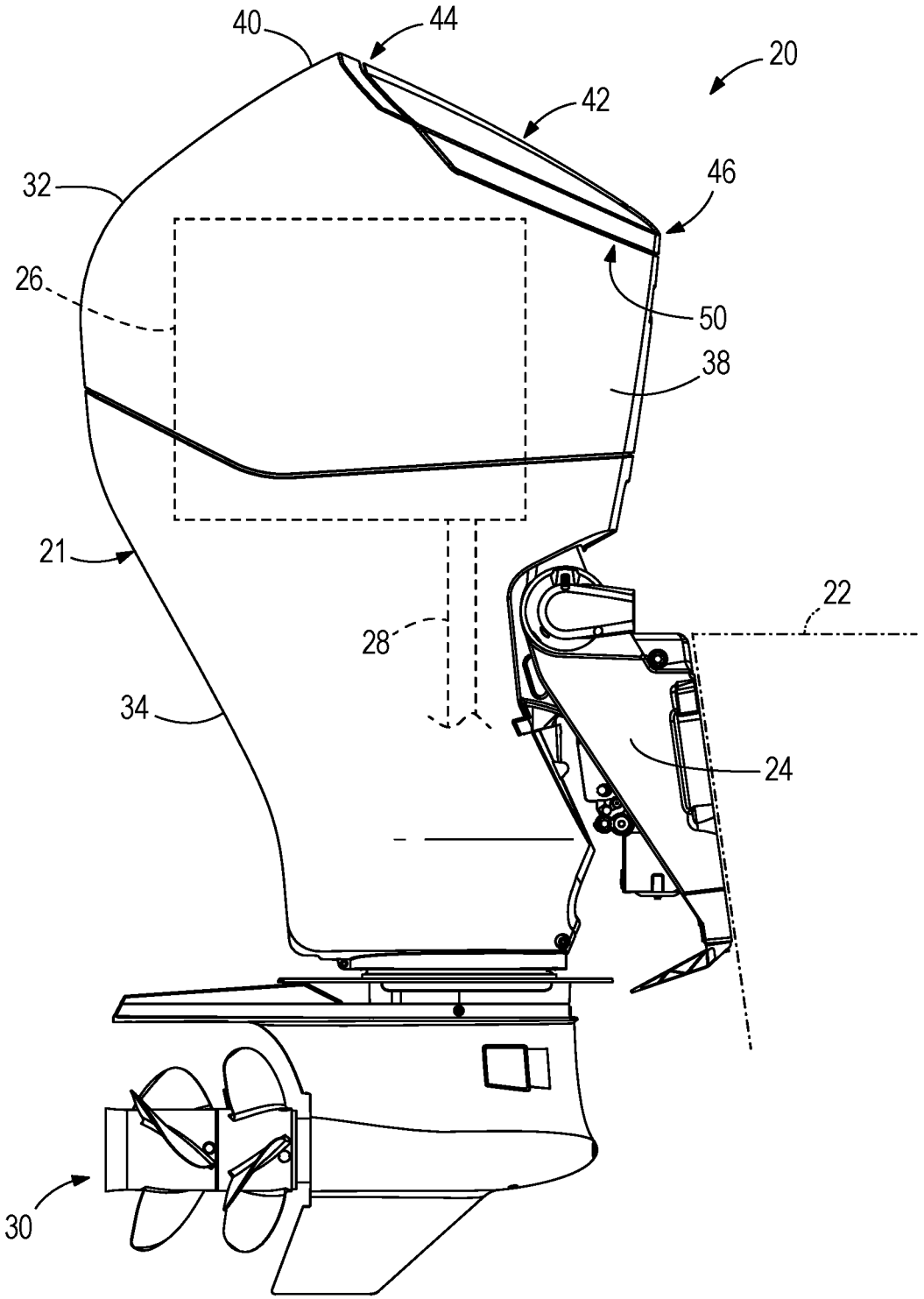
FIG. 1 is a starboard side view of an outboard motor coupled to the transom of a marine vessel, the outboard motor having a cowling that encloses a powerhead.

FIG. 1 depicts a marine drive for propelling a marine vessel in water. In the illustrated example, the marine drive is an outboard motor 20, which is coupled to the transom 22 of the marine vessel by a transom bracket 24. The outboard motor 20 has a powerhead 26, shown schematically, which can comprise an internal combustion engine and/or any other similar means for causing rotation of a driveshaft 28, which in turn powers a propulsor 30. In the illustrated example, the propulsor 30 comprises dual counter-rotating propellers; however the propulsor 30 can comprise any other conventional means for propelling the marine vessel. The type and configuration of marine drive and marine vessel can also vary from what is shown.

The outboard motor 20 has a cowling 21 with a top cowl portion 32 extending over the top of the powerhead 26 and a bottom cowl portion 34 surrounding and extending downwardly below the powerhead 26. The top and bottom cowl portions 32, 34 together define a sealed cowl interior 36 (FIG. 4) in which the powerhead 26 is located. The top cowl portion 32 can be fixed in place and/or otherwise mounted to the bottom cowl portion 32 by, for example bolted connections and/or latches and/or the like. One example of a suitable fixed connection assembly between the top cowl portion 32 and bottom cowl portion 34 is further disclosed in the present applicant's co-pending U.S. patent application Ser. No. 16/986,669. The type and configuration of cowling 21 can vary from what is shown, and the type and configuration of the connection assembly between the top and bottom cowl portions 32, 34 can vary and for example can comprise conventional bolted and/or latching connections and/or the like.

Figure 2:
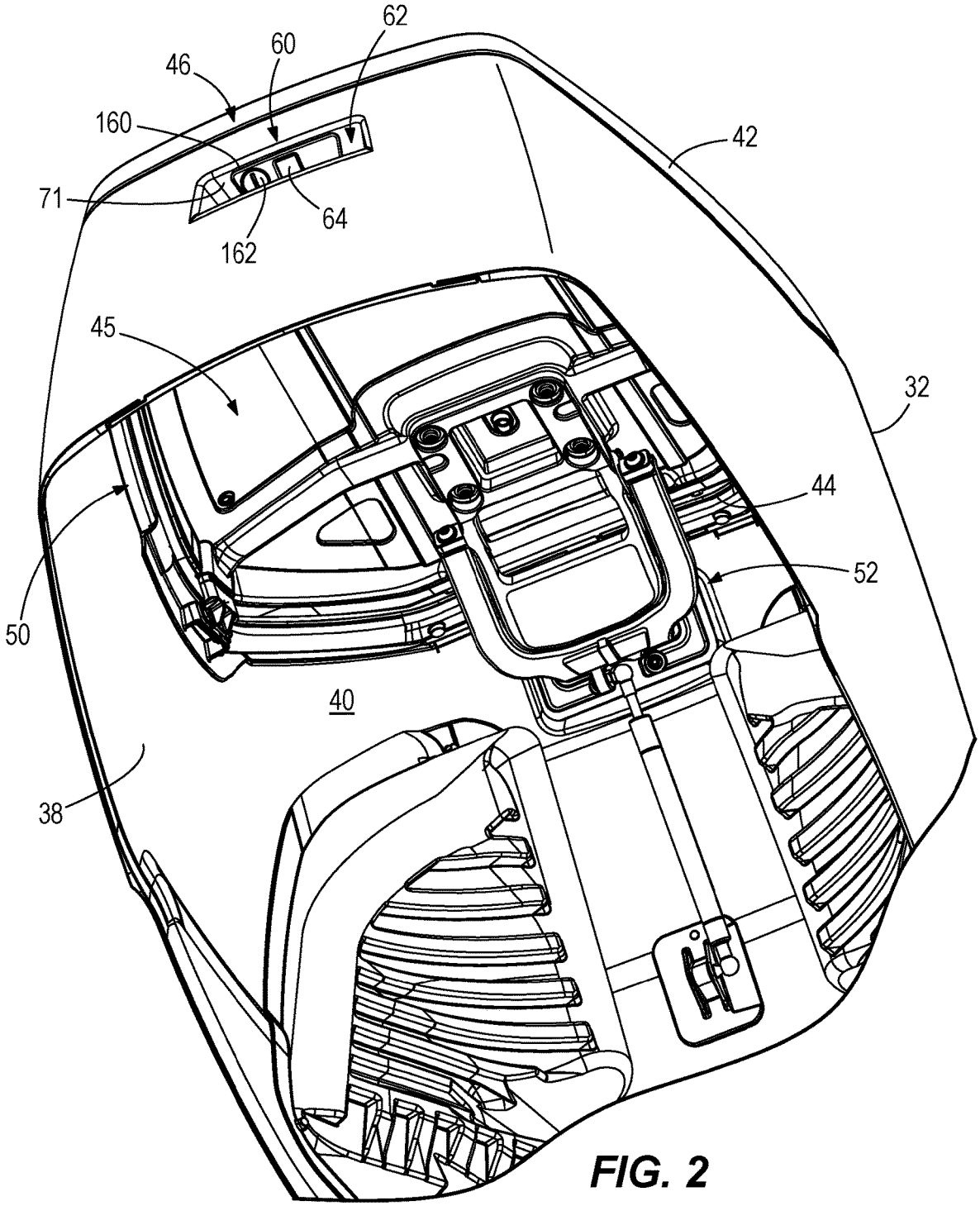
FIG. 2 is a view looking up at a top cowl portion of the cowling, in particular depicting a manually-operable input device for a novel latching device for latching an access door to the top cowl portion.
Figure 3:
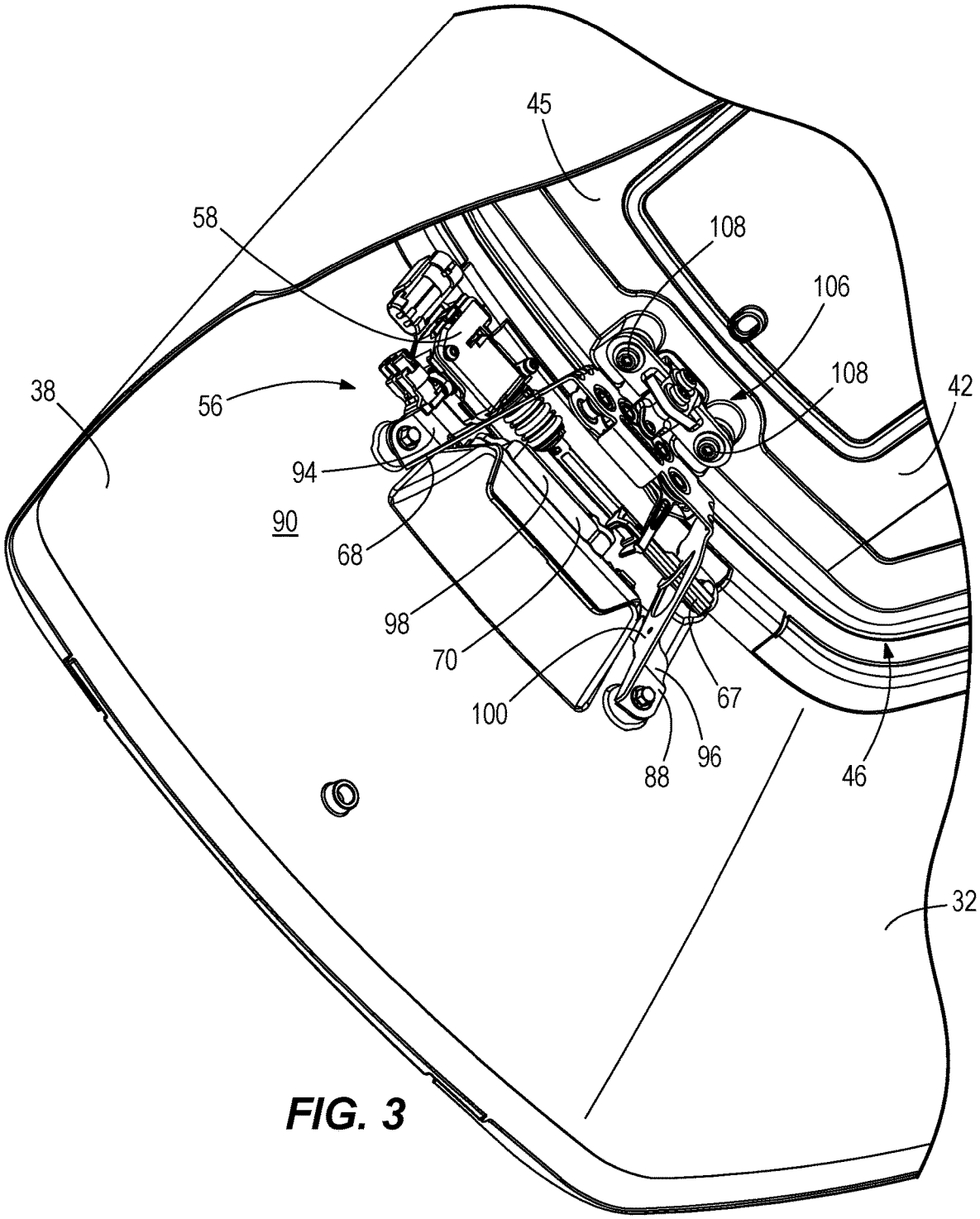
FIG. 3 a view looking up into the interior of the top cowl portion, depicting the interior of the access door and the latching device.

Referring to FIGS. 1-3, the top cowl portion 32 has a peripheral sidewall 38 that extends around the powerhead 26 and a top wall 40 that extends over the top of the powerhead 26. A novel access door 42 is pivotably coupled to the top cowl portion 32, in particular so as to provide manual access to the cowl interior 36 once the top cowl portion 32 is fixed to the bottom cowl portion 34. Thus, the top cowl portion 32 and access door 42 generally constitute first and second cowl portions, which together with the bottom cowl portion 34 enclose the powerhead 26. In the illustrated embodiment, the access door 42 has a generally trapezoidal perimeter shape and is located on top of the peripheral sidewall 38, in particular over the top of the powerhead 26 and adjacent to the top wall 40. The access door 42 has a radially outer perimeter with a rear side 44 that is pivotably coupled to the top wall 40, a front side 46 that is located opposite the rear side 44, and port and starboard sides 48, 50 that extend between the front and rear sides 44, 46, and angularly with respect to each other.

Referring to FIG. 2, the rear side 44 of the access door 42 is pivotably attached to the top cowl portion 32 by a novel hinge mechanism 52; however it should be recognized that the hinge mechanism 52 shown in the figures is merely one example of a suitable mechanism for pivotably connecting the access door 42 to the top cowl portion 32. The concepts of the present disclosure are not limited for use with the particular hinge mechanism 52 shown in the figures. For example, in alternate embodiments, the rear side 44 of the access door 42 is pivotably coupled to the top cowl portion 32 by one or more conventional piano hinges and/or the like. It should also be recognized that the shape, size and location of the access door 42 is exemplary and can vary from what is shown.

Figure 8:
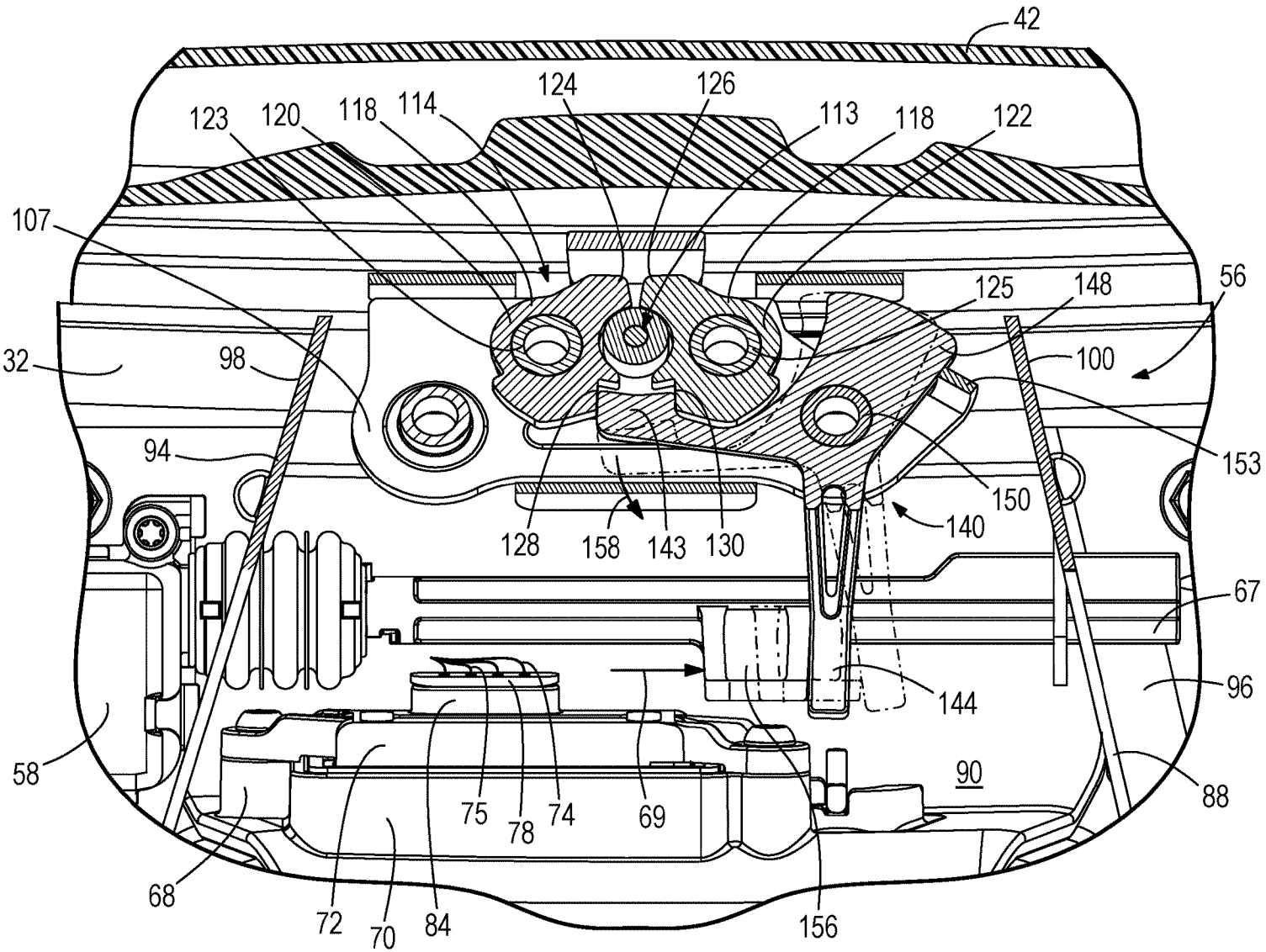
FIG. 8 is a view like FIG. 7, showing engagement between a pawl mechanism and an engagement member.

The access door 42 is thus pivotable along its rear side 44 into and between a closed cowl position (FIG. 1) and an open cowl position (FIG. 8). In the closed cowl position, the bottom surface 45 (see FIG. 4) of the access door 42, particularly along the outer perimeter, face an upper perimeter edge 54 of the peripheral sidewall 38 of the top cowl portion 32. Preferably a rubber seal (not shown) such as a band and/or gasket is located along the perimeter edge 54 and/or along the bottom surface 45 of the access door 42 so that when the access door 42 is pivoted into the closed cowl position, the rubber seal is compressed and a water-tight seal is formed along the perimeter of the access door 42 and the top cowl portion 32, thus preventing ingress of water to the cowl interior 36 and onto the powerhead 26.

Figure 4:
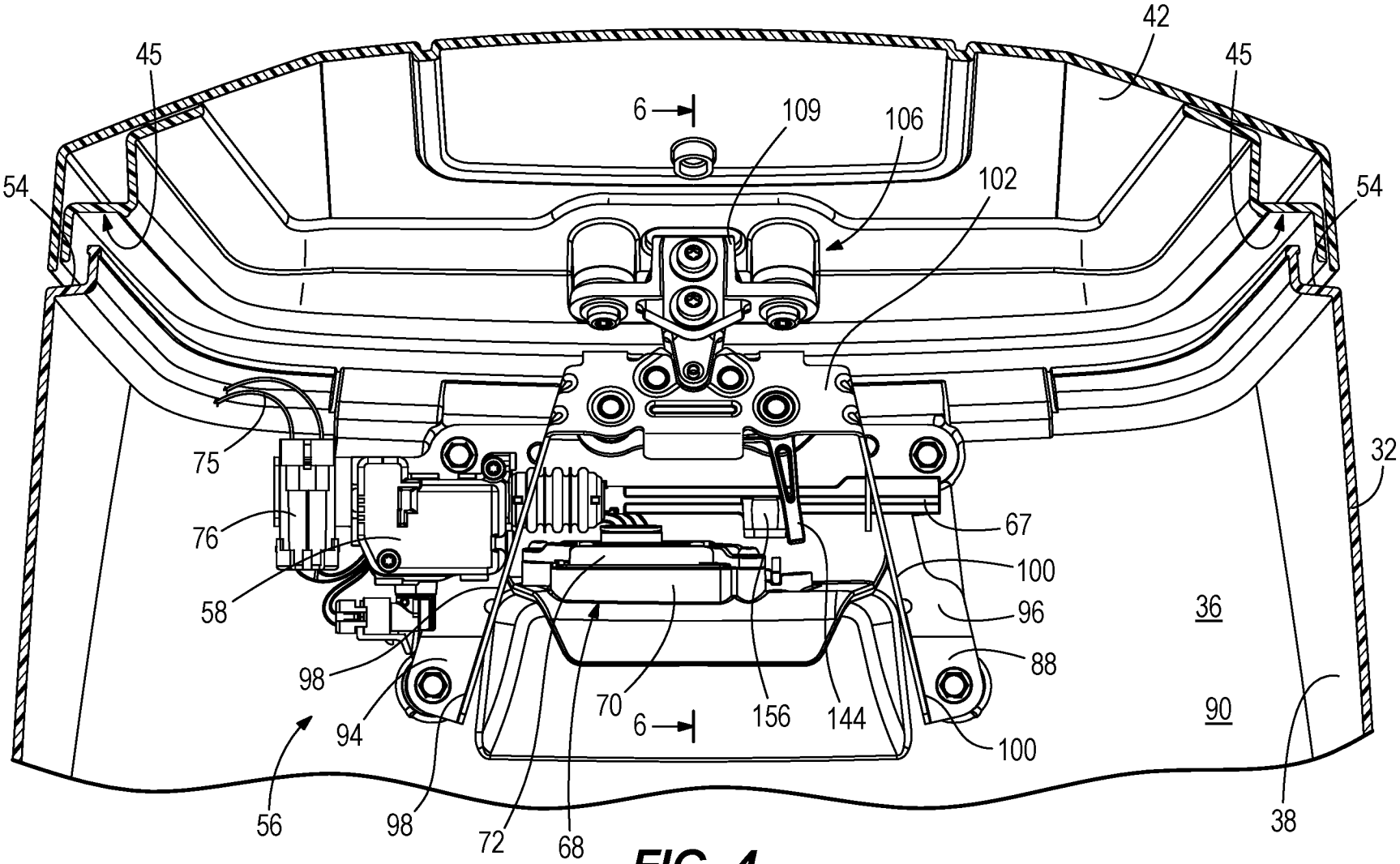
FIG. 4 is a front view of the latching device.
Figure 5:
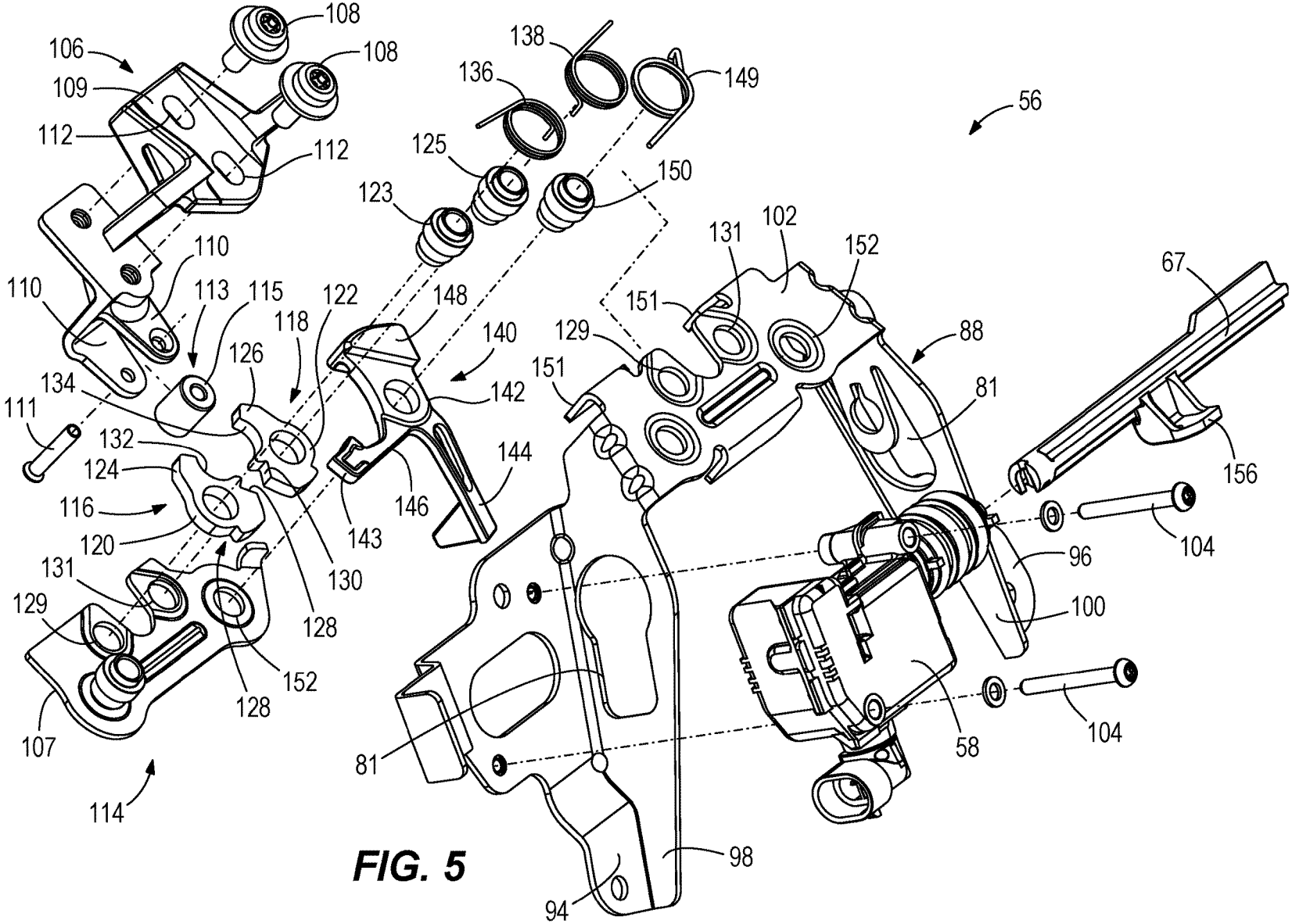
FIG. 5 is an exploded view of the latching device.
Figure 6:
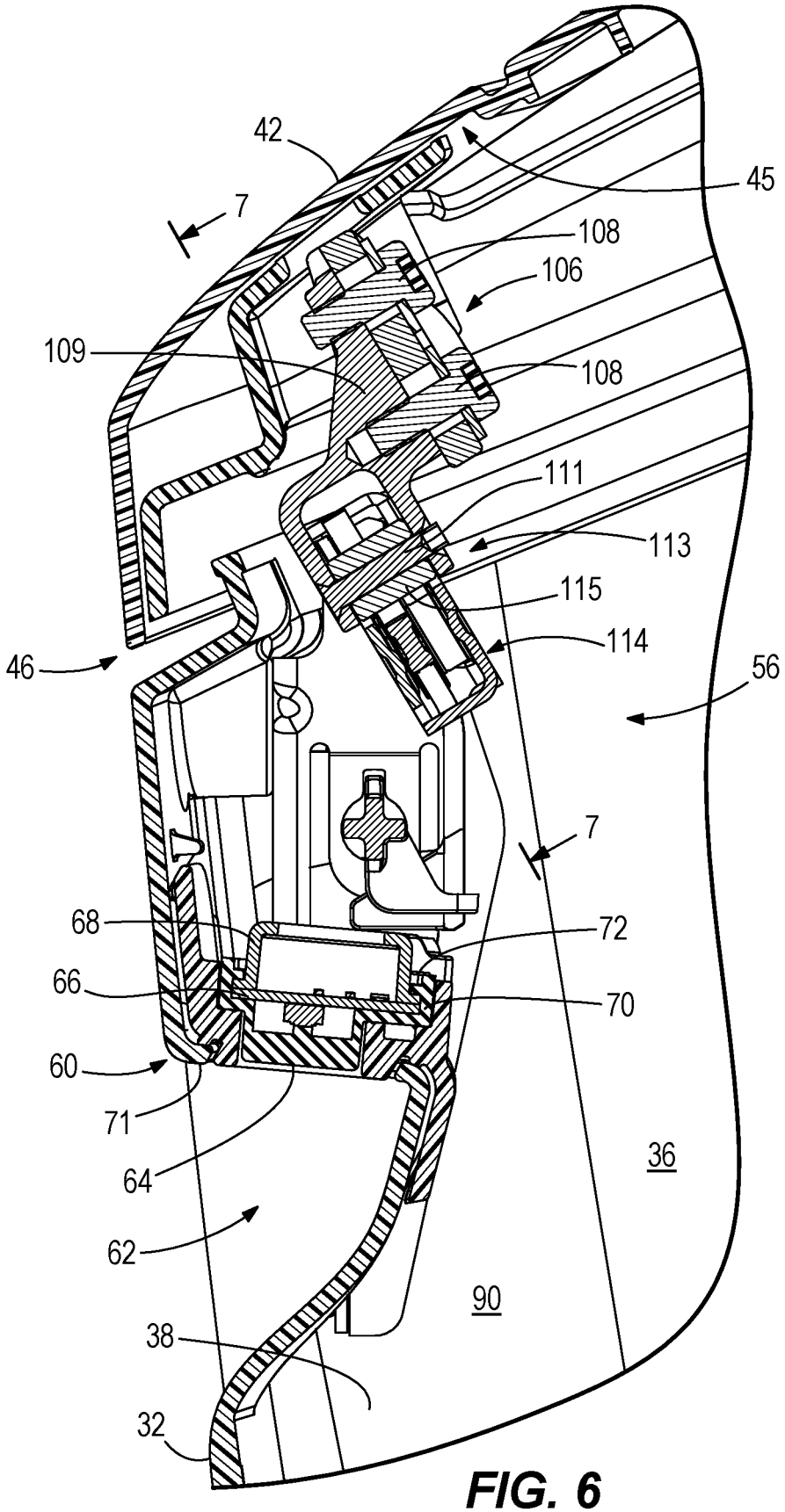
FIG. 6 is a view of section 6-6, taken in FIG. 4.

Referring to FIGS. 3-5, the front side 46 of the access door 42 is latch-able to the top cowl portion 32 by a novel latching device 56, which is a subject of the present disclosure. Latching the front side 46 of the access door 42 to the top cowl portion 32 thus encloses the powerhead 26 in the cowl interior 36. Unlatching the access door 42 from the top cowl portion 32 permits pivoting movement of the access door 42 from the closed cowl position to the open cowl position, as described herein above, thus permitting manual access to the cowling interior 36 and powerhead 26. As will be more fully described herein below, the latching device 56 advantageously comprises an electric actuator 58 configured to automatically move the latching device 56 from the latched position to the unlatched position and a novel, manually-operable input device 60 that is accessible from outside the cowling 21 and configured to actuate the electric actuator 58.

Referring to FIGS. 1, 6 and 10-12, the manually-operable input device 60 is ergonomically accessible from outside of the cowling 21 when the top cowl portion 32 is in the closed cowl position. In the illustrated example, the cowling 21 has a hand recess 62 formed in the peripheral sidewall 38, below the front side 46 of the access door 42, which is also along the front side of the outboard motor 20. The manually-operable input device 60 has a push-button 64 that protrudes through a top wall 71 of the hand recess 62. A printed circuit board 66 is located inside the cowling interior 36, and more specifically is seated in a novel supporting housing 68 mounted to the interior of the top cowl portion 32, opposite the top wall 71 of the hand recess 62, for example by fasteners 65.

Figure 11:
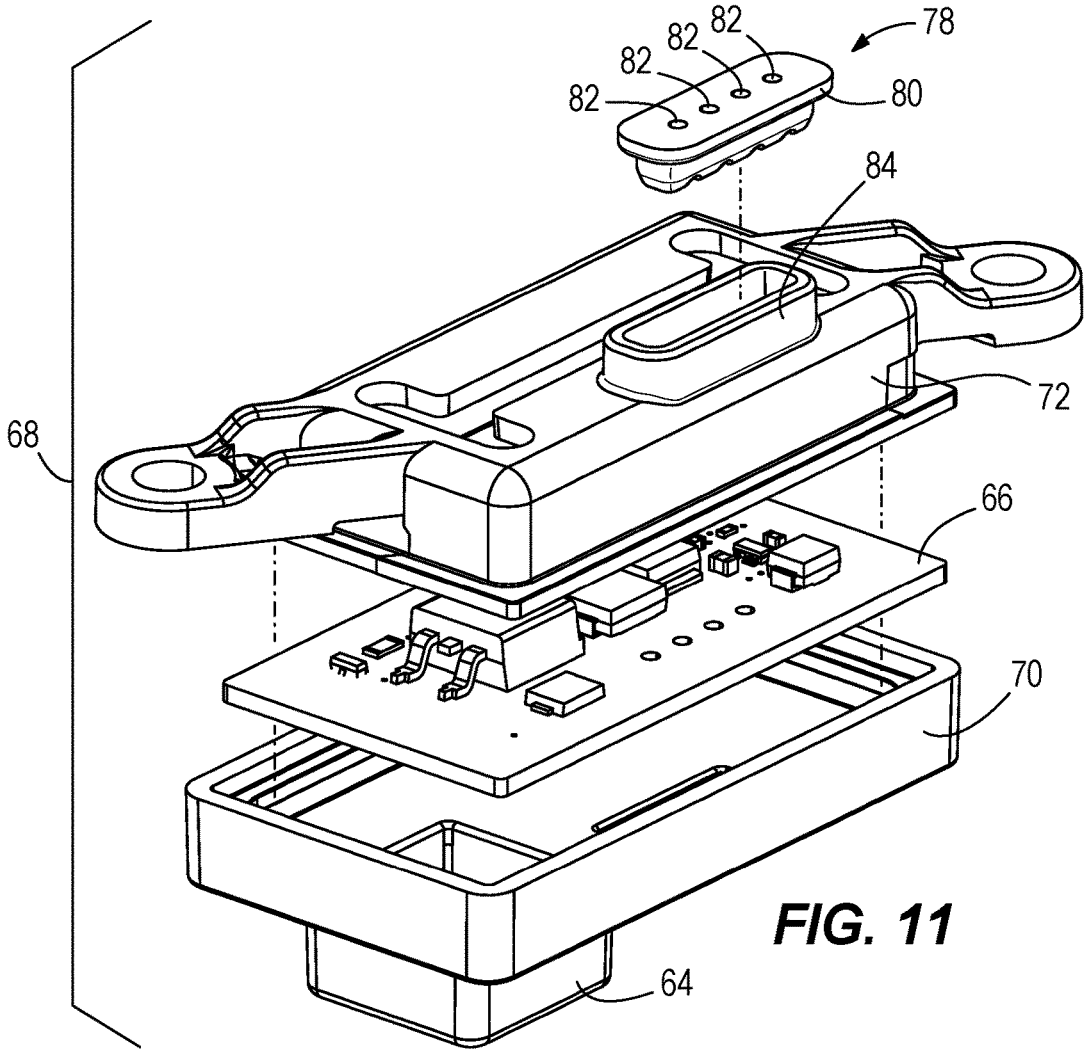
FIG. 11 is an exploded view of the manually-operable input device.
Figure 12:
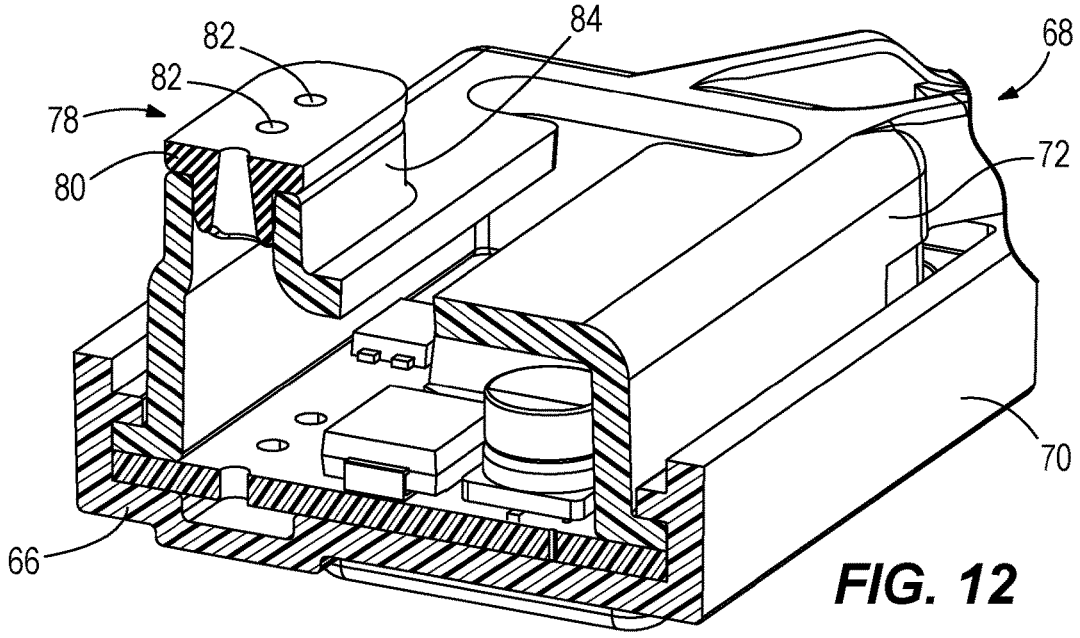
FIG. 12 is a view of section 12-12, taken in FIG. 10.

As shown in FIGS. 11-12, the supporting housing 68 comprises a rubber or nylon backing tray 70 in which the printed circuit board 66 is seated, and a cover 72 mated with the backing tray 70. The backing tray 70 overlaps the perimeter edges of the cover 72 and thus together the backing tray 70 and the cover 72 define an interior of the supporting housing 68, which during assembly is filled with a potting compound, such as rubber epoxy, which creates a seal in the interior and protects the printed circuit board 66 from environmental elements, such as water. Electrically conductive wires 74 have one end connected to the printed circuit board 66 and an opposite end connected to the electric actuator 58. Electrically conductive wires 75 have one end connected to the printed circuit board 66 and an opposite end connected to a source of electrical power, such as a battery 76. In particular, the electrically conductive wires 74, 75 convey electrical signals from the printed circuit board 66 to the electric actuator 58 and electrical power from the battery 76 to the printed circuit board 66. The electrically conductive wires 74, 75 extend from the supporting housing 68, in particular through a novel strain-relieving grommet 78. The strain-relieving grommet 78 has a body 80 with a series of through-bores 82 through which the electrically conductive wires 74 extend. The body 80 is nested in the top of the cover 72, in particular seated in a rigid boss 84 that protrudes from the top of the cover 72. The strain-relieving grommet 78 is preferably made of rubber or another similar resilient material and is press-fit into the rigid boss 84 so that a water-tight seal is formed there between, which inhibits ingress of water to the interior of the supporting housing 68. The through-bores 82 in the strain-relieving grommet 78 have gradually widened lower ends which facilitate assembly with the electrically conductive wires 74, 75. During assembly, the conductive wires 74, 75 are first installed through the lower ends of the through-bores 82, prior to soldering the ends of the conductive wires 74, 75 to the printed circuit board 66. The strain-relieving grommet 78 is then manually pressed down into the rigid boss 84 in the cover 72. Advantageously the strain-relieving grommet 78 and rigid boss 84 together provide protective strain relief for the conductive wires 74, 75 and for example prevent the potting compound from being pulled out of place during movement of the wires 74, 75 in such a way that potentially creates a leak path for water to infiltrate the device and negatively impact the printed circuit board 66.

The push-button 64 is located on the bottom of the supporting housing 68 and is connected to the printed circuit board 66. The printed circuit board 66, electrical wires 74, 75 and push-button are configured in a conventional manner such that pressing the push-button 64 actuates the printed circuit board 66 and causes the printed circuit board 66 to produce an electric signal that is conveyed by one or more of the electrically conductive wires 74 to the electric actuator 58. In other words, manually pressing the push-button 64, which accessible from outside of the cowling 21 via the hand recess 62, causes the printed circuit board 66 to electronically actuate the electric actuator 58, which as described herein below moves the latching device 56 from the latched position to the unlatched position. The push-button 64 and printed circuit board 66 are conventional items that are commercially available from a variety of commercial providers of tactile switches, for example from C&K part number KSC343GLFG. Other conventional actuators including conventional tactile switches could also or instead be employed. The electric actuator 58 is an electric motor, which is also a conventional item that for example is commercially available from Hella, part number 6NW 009.203-501. Any other type of suitable electric motor could instead be employed. In the illustrated embodiment, the electric actuator 58 is a linear actuator having an output arm 67 that is caused by the electric motor to move linearly back and forth with respect to the electric motor, as will be further described herein below.

Referring to FIGS. 4 and 5, a latch bracket 88 is fixed to the interior surface 90 of the peripheral sidewall 38 of the top cowl portion 32, adjacent to the front side 46 of the access door 42, for example by fasteners. The latch bracket 88 has opposing side arms 94, 96, which are fastened to the interior surface 90, opposing flange arms 98, 100 that transversely extend from the side arms 94, 96, respectively, radially inwardly with respect to the cowl interior 36, and a cross arm 102 having opposing ends connected to the flange arms 98, 100. The electric actuator 58 and battery 76 are attached to the side arm 94 by, for example fasteners 104. The output arm 67 of the electric actuator 58 extends through keyhole apertures 81 in the flange arms 98, 100. The output arm 67 is normally in a retracted, rest position until being actuated by the electric actuator 58. Actuation of the electric actuator 58 by pressing the push-button 64 causes the electric actuator 58 to move the output arm 67 from its rest position, outwardly relative to the electric actuator 58 in the direction of arrow 69 in FIG. 8, and then back inwardly to its retracted rest position.

Referring to FIGS. 4 and 5, a mounting bracket 106 is fixed to the bottom surface 45 of the access door 42, along the front side 46, for example by fasteners 108. The mounting bracket 106 has a body 109 and a pair of angle brackets 110 extending from the body 109. An engagement member 113, which in the illustrated example comprises an elongated roller pin 115, is rotatable about fastener 111 extending between the angle brackets 110. Optionally, the mounting bracket 106 has elongated through-bores 112 into which the fasteners 108 are installed, which allows the installer to manually adjust the position of the mounting bracket 106 and associated engagement member 113 during installation, thereby ensuring proper alignment with the rest of the latching device 56 so as to facilitate latching, as will be further described herein below.

Referring to FIGS. 4 and 5, the latching device 56 is manually actuated by pressing the push-button 64. The latching device 56 is normally positioned in a latched position, shown in FIG. 8, wherein the latching device 56 retains the engagement member 113 to thereby retain the access door 42 in its closed position. The latching device 56 further comprises a novel pawl mechanism 114, which will be described herein below. Pressing the push-button 64 electrically actuates the electric actuator 58, which in turn moves the output arm 67 so that it engages with and actuates the pawl mechanism 114 to release the engagement member 113 and permit pivoting of the access door 42 into its opened position.

Figure 7:
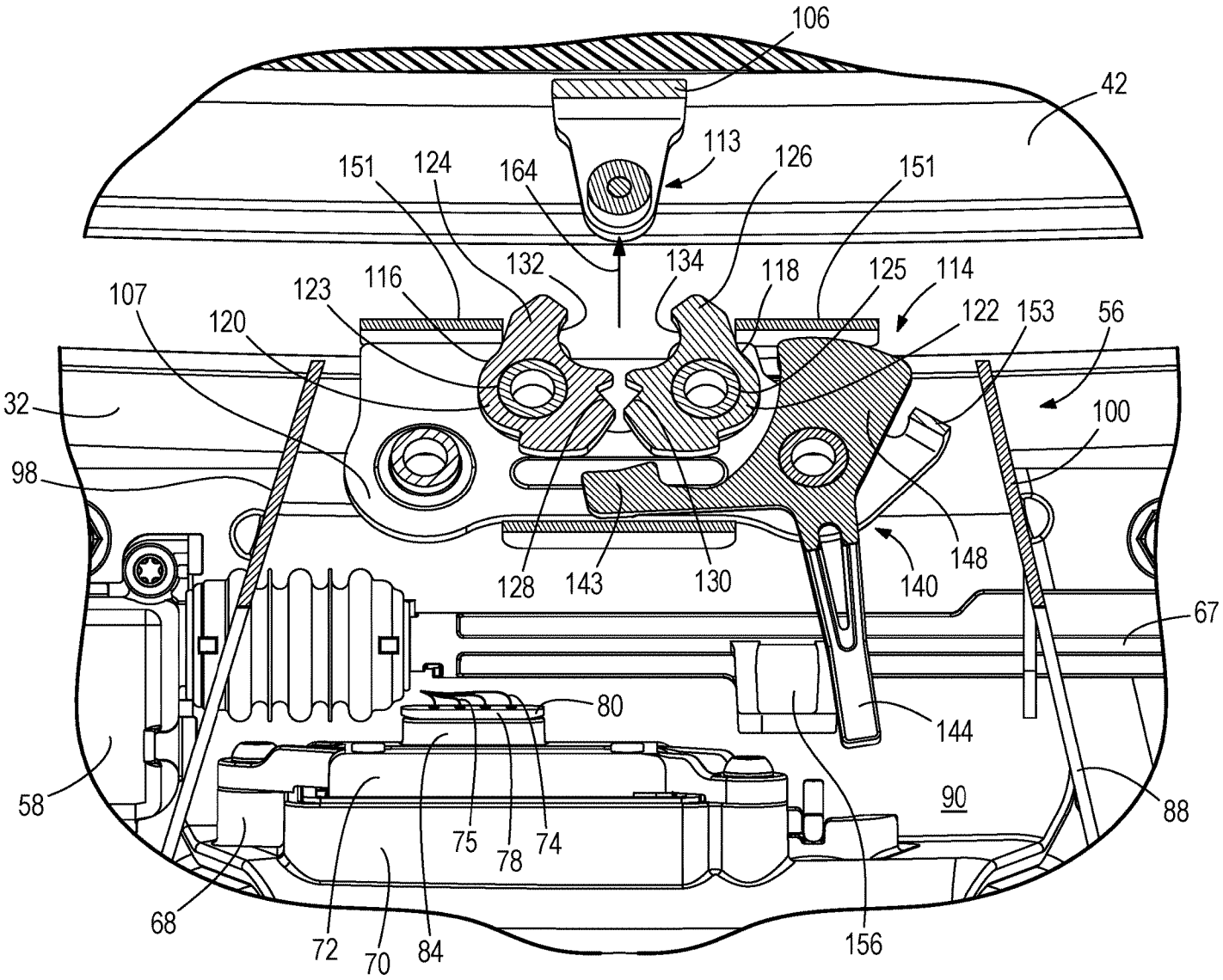
FIG. 7 is a view of section 7-7, taken in FIG. 6.

The pawl mechanism 114 is mounted on the latch bracket 88 and is movable into and between a closed position (FIG. 8) and an opened position (FIG. 7). The pawl mechanism 114 comprises first and second pawl members 116, 118 which are rotatable about first and second pawl hubs 123, 125 mounted in through-bores 129, 131 in the cross arm 102 of the latch bracket 88 and a backing bracket 107 on the cross arm 102. The first and second pawl members 116, 118 rotate about first and second pawl axes, which are parallel and spaced apart from each other.

Each of the first and second pawl members 116, 118 has a respective pawl body 120, 122 and an engagement finger 124, 126 that radially extends from the pawl body 120, 122. As shown in FIG. 8, the engagement fingers 124, 126 are normally rotated towards each other when the pawl mechanism 114 is in its closed position and the latching device 56 is in its latched position. As shown in FIG. 7, the engagement fingers 124, 126 are rotated away from each other when the pawl mechanism 114 is moved into its opened position and the latching device 56 is permitted to move into its unlatched position.

Each of the first and second pawl members 116, 118 has a radial cutout 128, 130 which is peripherally spaced apart from the respective engagement finger 124, 126 on the respective pawl body 120, 122. As shown in FIG. 7, the radial cutouts 128, 130 face downwardly and together define a space or pocket for receiving a trigger member 140 (which will be further explained herein below) when the pawl mechanism 114 is in the closed position and the latching device 56 is in the latched position. Each of the pawl members 116, 118 further has a radially inwardly curved perimeter surface 132, 134, which is located perimeterally between the respective engagement finger 124, 126 and radial cutout 128, 130 on the pawl body 120, 122. As shown in FIG. 8, the curved perimeter surfaces 132, 134 face each other so as to enclose and retain the engagement member 113 in the noted pocket when the pawl mechanism 114 is in its closed position and the latching device 56 is in the latched position. When the pawl members 116, 118 are rotated into the opened position, as shown in FIG. 7, the curved perimeter surfaces 132, 134 face generally upwardly so as to release and also so as to again receive the engagement member 113.

Referring to FIG. 5, first and second pawl springs 136, 138 bias the first and second pawl members 116, 118 into the opened position, shown in FIG. 7. Referring to FIG. 5 and FIGS. **9A-9*c*, the first and second pawl springs 136, 138 are torsion springs having a first end 145 coupled to the respective pawl member 116, 118 and a second end 147 coupled to flanges 151 extending from the cross arm 102 of the latch bracket 88. The natural resiliency of the torsion springs tends to cause the pawl members 116, 118 to rotate into the opened position, shown in FIG. 7. It should be recognized that the type and configuration of the first and second pawl springs 136, 138** can vary and for example could be coil springs.

Referring to FIG. 5, as mentioned above, the pawl mechanism 114 further comprises a trigger member 140 for retaining the pawl mechanism 114 in the closed position and for releasing the pawl mechanism 114 to automatically move into the opened position. The trigger member 140 has a trigger body 142, an actuator arm 144 that radially extends from the trigger body 142 towards the output arm 67 of the electric actuator 58, and a trigger arm 146 that radially extends from the trigger body 142, towards and below the first and second pawl members 116, 118. The trigger arm 146 has an engagement finger 143 that transversely extends from the trigger arm 146 and is sized to fit within the space defined between the radial cutouts 128, 130 when the pawl mechanism 114 is in the closed position shown in FIG. 8. In this position, the first and second pawl members 116, 118, in particular the surfaces along the first and second radial cutouts 128, 130 engage opposite sides of the engagement finger 143 and are biased into such engagement by the pawl springs 136, 138. In this position the first and second pawl members 116, 118 are prevented from rotating, counter-clockwise in the figures, under the biasing force of the first and second pawl springs 136, 138. The trigger member 140 also has a counterweight 148 that radially extends from the trigger body 142, radially opposite the actuator arm 144 and trigger arm 146. The counterweight 148 balances the trigger member 140 about its rotational axis, which limits unwanted motion when the latch experiences external accelerations from rough water driving and logstrikes.

Referring to FIG. 5, the trigger body 142 is mounted on the latch bracket 88, and in particular is configured to rotate on a trigger hub 150 that is mounted in a through-bore 152 in the cross arm 102 of the latch bracket 88 and backing bracket 107. Thus the trigger member 140 is rotatable about a rotational axis defined through the trigger hub 150, which is parallel to and spaced apart from the first and second pawl axes. A trigger spring 149, biases the trigger member 140 into the position shown in FIG. 8. The trigger spring 149 is a torsion spring having a first end coupled to the trigger member 140 and a second end coupled to the latch bracket 88. The natural resiliency of the torsion spring tends to cause trigger member 140 to rotate into the position shown in FIG. 8. It should be recognized that the type and configuration of the trigger spring 140 can vary and for example could be a coil spring.

An actuator tab 156 transversely extends from the output arm 67 of the electric actuator 58 and engages with the actuator arm 144 to cause rotation of the trigger member 140 about the trigger axis, counter-clockwise in the figures, as shown at arrow 158 in FIG. 8, thus moving the engagement finger 143 from its position in FIG. 8 to its position in FIG. 7, disengaged from the first and second pawl members 116, 118, and such that the first and second pawl members 116, 118 are thereafter caused to rotate by first and second pawl springs 136, 138, into the opened position shown in FIG. 7, so as to release and thereafter again be in position to receive the engagement member 113.

Referring to FIG. 2, an access bore 160 is formed through the top wall 40 of the hand recess 62 is plugged by a removable plug 162. In cases where the latching device 56 fails, for example if the electric actuator 58 breaks or the battery 76 runs out of charge, a technician can manually remove the removable plug 162 and insert a tool, such as screwdriver and/or the like, through the access bore 160 and into engagement with the trigger member 140, to thereby pivot the trigger member 140 and cause the engagement finger 143 to rotate out of the position shown in FIG. 8, thus permitting the first and second pawl springs 136, 138 to rotate the first and second pawl members 116, 118, releasing the roller pin 115 and unlatching the latching device 56 and permitting manual pivoting of the access door 42 into its opened position and permitting access to the latching device 56 for repair.

Figure 9A:
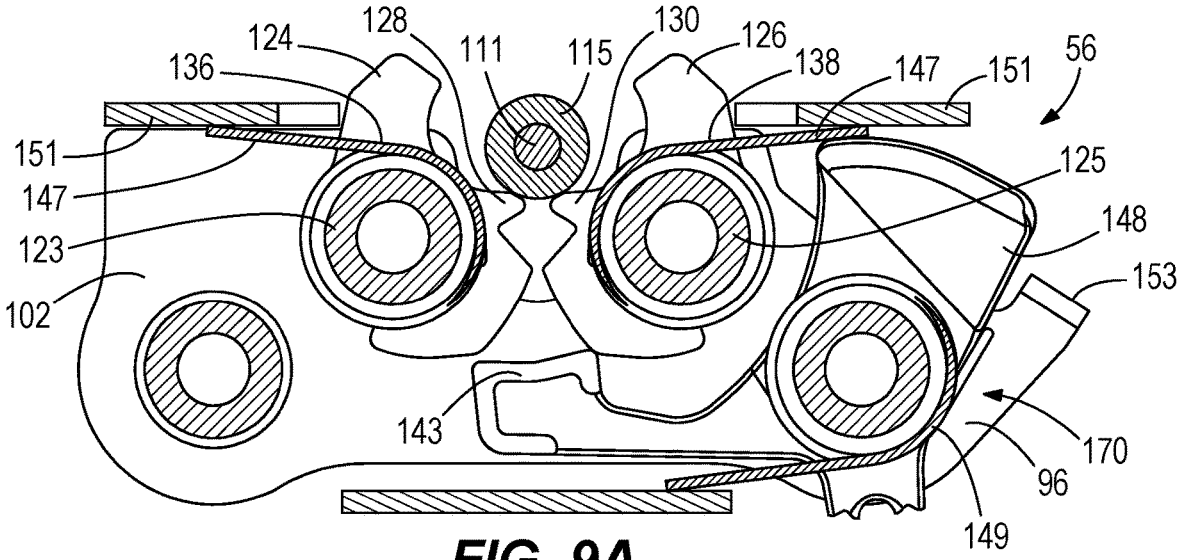
FIG. 9A is a view of the latching device in an unlatched position.
Figure 9B:
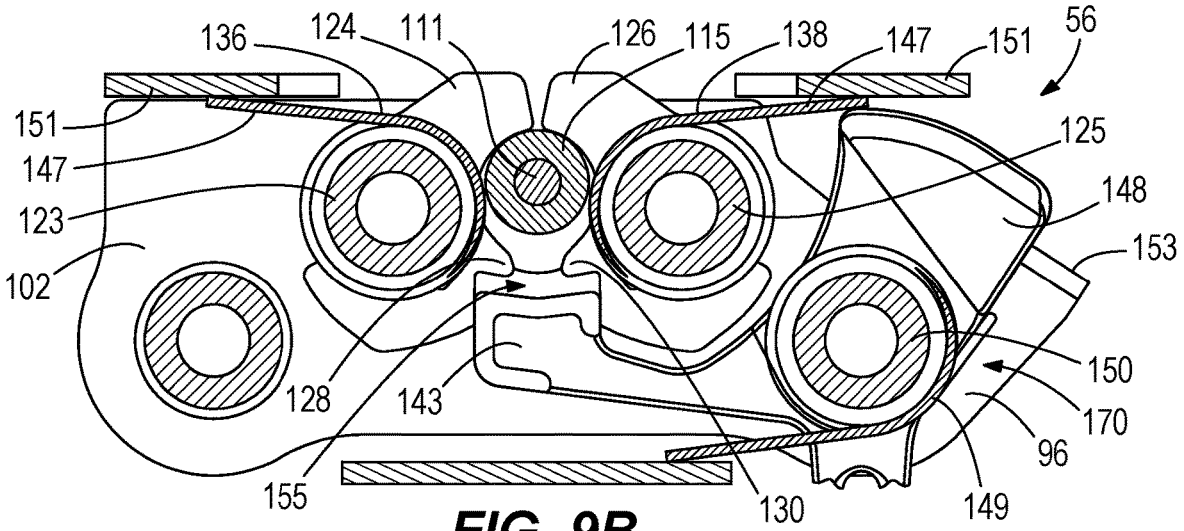
FIG. 9B is a view of the latching device in a latched position.

In use, referring to FIGS. 9A-9B, when the access door 42 is in its opened position, the pawl mechanism 114 is normally biased into the position shown in FIG. 9A by the first and second pawl springs 136, 138. Manually pivoting the access door 42 towards its closed position brings the roller pin 115 into engagement with the innermost ends of the radially inwardly curved perimeter surfaces 132, 134 of the first and second pawl members 116, 118. Further manual pivoting of the access door 42 rotates the first and second pawl members 116, 118 inwardly towards each other until the first and second radial cutouts 128, 130 are in the position shown in FIG. 9B wherein the roller pin 115 is retained within the noted pocket and whereupon the engagement finger 143 is biased into the position shown, i.e., between the first and second radial cutouts 128, 130, under the biasing force of the trigger spring 140. Seating of the engagement finger 143 in the position shown in FIG. 9B prevents the first and second pawls 116, 118 from thereafter rotating back away from each other towards the opened position shown in FIG. 9A, and securely retains the roller pin 115 in the pocket defined by the radial cutouts 128, 130 and adjacent engagement fingers 124, 126, thus retaining the latching device 56 in the latched position and keeping the access door 42 in its closed position, and enclosing the powerhead 26 in the cowl interior 36.

Figure 9C:
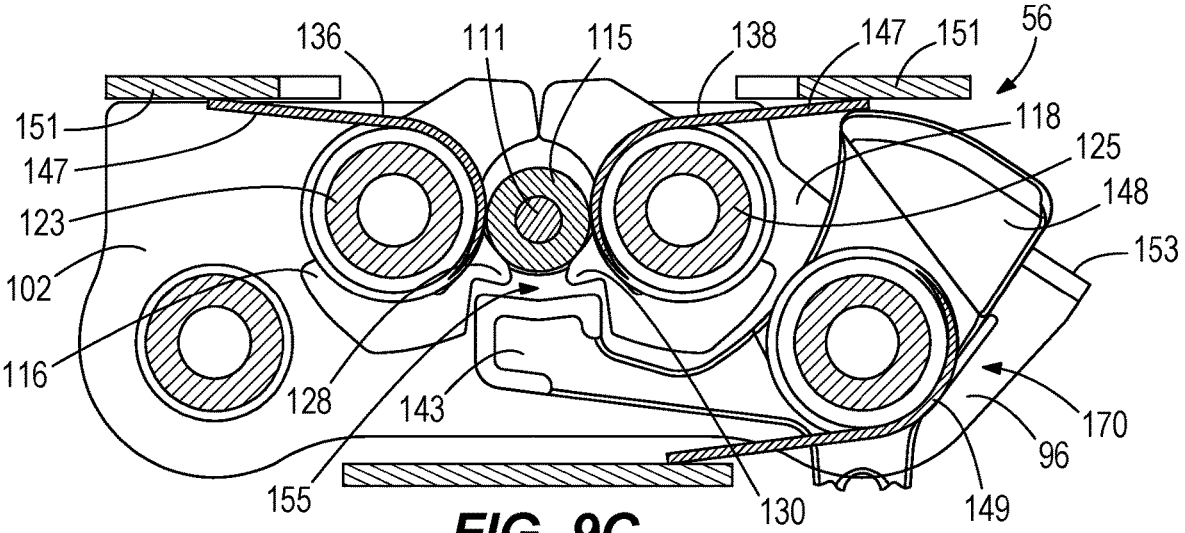
FIG. 9C is a view of the latching device in the latched position after an impact load on the top cowl portion.
Figure 10:
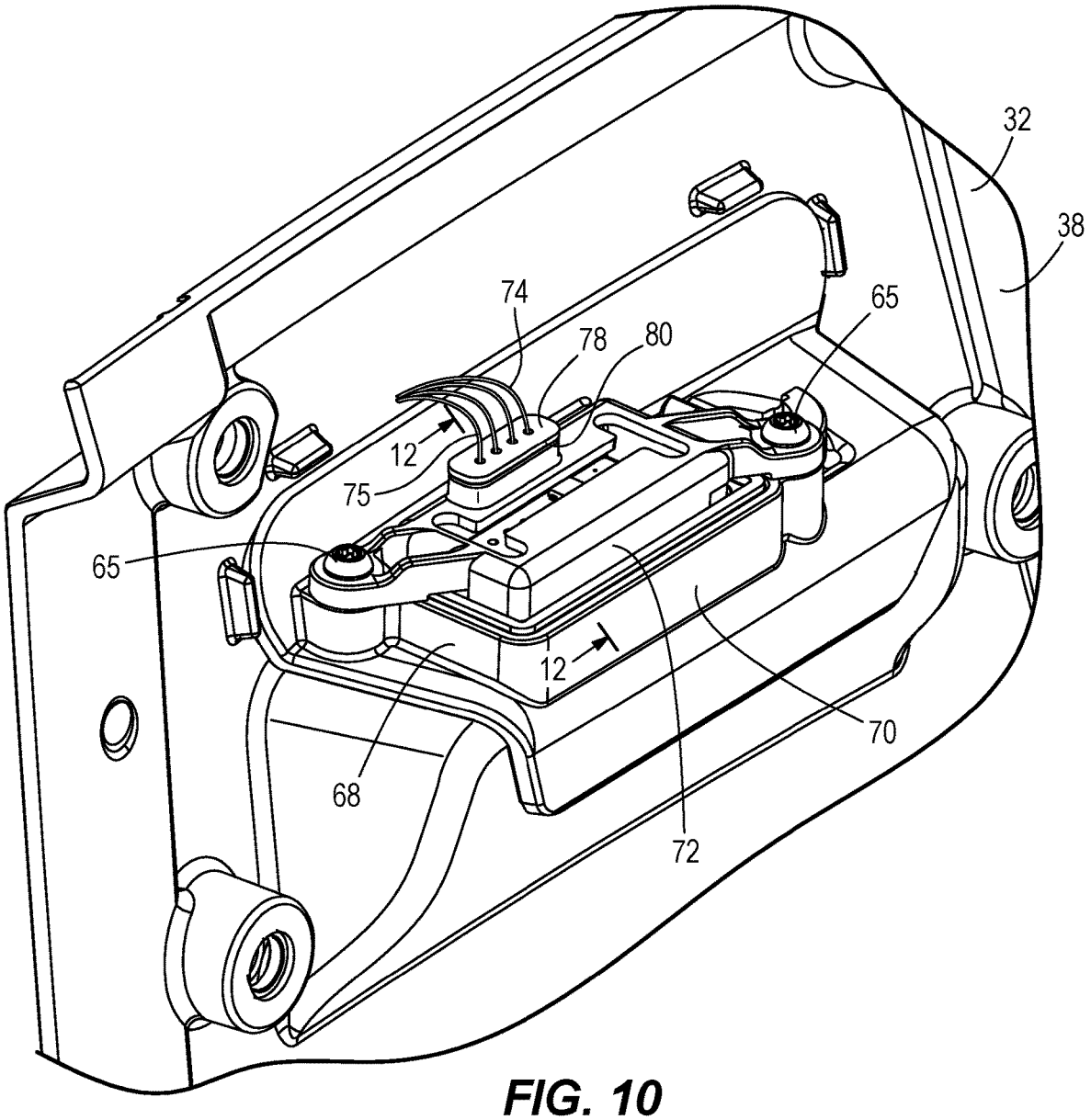
FIG. 10 is a view of the manually-operable input device from inside of the top cowl portion.

Referring to FIG. 9B, in the latched position, a flange 153 on the side arm 96 of the latch bracket 88 is engaged by the counterweight 148, which thereby prevents the trigger member 140 from over-rotating in the clockwise direction. This maintains a gap 155 between the engagement finger 143 and the radial cutouts 128, 130, which as further explained herein below advantageously reduces the likelihood that the latching device 56 becomes unintentionally unlatched when for example the cowling top cowl portion 32 is subjected to an impact load. More specifically, a preload force (i.e., torque) on the access door 42 relative to the top cowl portion 32 normally causes the roller pin 115 to be positioned towards the top of the pocket, as shown in FIG. 9B. However the roller pin 115 can, under an impact force, translate downwardly in the pocket into the position shown in FIG. 9C, which could impact the radial cutouts 128, 130. Upon such an impact, engagement of the engagement fingers 124, 126 normally prevents rotation of the pawl members 116, 118 out of their closed position and keeps the pawl mechanism 114 in its closed position. However the present inventors realized that the impact force potentially could dislodge the trigger member 140 from its position shown in FIG. 9B, which would permit the latching device 56 to unintentionally unlatch. To prevent this, the present inventors determined that is advantageous to maintain the noted gap 155 between the engagement finger 143 and the radial cutouts 128, 130. To cause the access door 42 to move back into its opened position, the user manually presses the push-button 64, which causes the electric actuator 58 to move the output arm 67 until the actuator tab 156 engages with the actuator arm 144 and thus rotates the trigger member 140 counterclockwise about its rotational axis, thus withdrawing the engagement finger 143 from between the first and second pawls 116, 118 and permitting the first and second pawl springs 136, 138 to rotate the first and second pawls 116, 118 into the opened position shown in FIG. 9A. Optionally, the printed circuit board 66 can be configured such that pushing the push-button 64 causes the printed circuit board 66 to actuate the electric actuator 58 only after a time delay, for example a second or two.

Thus it will be understood that the present disclosure provides a novel cowling for a marine drive and a novel latching device for latching the cowling of the marine drive. The cowling comprises first and second cowl portions for enclosing a powerhead and the latching device which is movable into a latched position in which the powerhead is enclosed by the first cowl and second cowl portions and an unlatched position in which the second cowl portion is movable with respect to the first cowl portion so that the powerhead is accessible. The latching device comprises an electric actuator configured to automatically move the latching device from the latched position to the unlatched position and a manually-operable input device which is accessible from outside of the cowling and is configured to actuate the electric actuator to thereby automatically move the latching device from the latched position to the unlatched position.

The latching device further comprises a pawl mechanism on a first one of the first and second cowl portions and an engagement member on a second one of the first and second cowl portions, the pawl mechanism being movable by the electric actuator into and between a closed position for retaining the engagement member when the latching device is in the latched position and an opened position for releasing and receiving the engagement member when the latching device is in the unlatched position. The pawl mechanism comprises first and second pawl members that are rotatable about first and second pawl axes, respectively, the first and second pawl axes being spaced apart from each other. The first and second pawl members in the closed position retain the engagement member there between and thus retain the first and second cowl portions together so as to enclose the powerhead, and alternately the first and second pawl members are movable into the opened position so as to release the engagement member and thereby allow the first and second cowl portions to be separated from each other so the powerhead is accessible. First and second pawl springs that cause the first and second pawl members, respectively, to rotate about the first and second pawl axes so that the pawl mechanism is biased into the opened position.

The first and second pawl members comprise first and second engagement fingers, respectively, which retain the engagement member in a pocket defined between the first and second pawl members when the pawl mechanism is in the closed position. A trigger member is included, wherein the electric actuator is configured to move the trigger member out of engagement with the first and second pawl members to thereby permit movement of the pawl mechanism into the opened position. Disengagement of the trigger member from the first and second pawl members causes the pawl mechanism to automatically move into the opened position. The electric actuator is configured to rotate the trigger member, to thereby disengage the trigger member from the first and second pawl members. The trigger member is biased into engagement with the first and second pawl members to thereby retain the pawl mechanism in the closed position, by a trigger spring. The first and second pawl members are rotatable about first and second pawl hubs and the trigger member is rotatable about a trigger hub, each of the first and second pawl hubs and trigger hub being spaced apart from each other. The trigger member comprises an engagement finger, and the first and second pawl members comprise cutout surfaces that engage opposite side surfaces of the engagement finger when the trigger member is engaged with the first and second pawl members.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may comprise other examples that occur to those skilled in the art. Such other examples are intended to be within the scope of the claims if they have features or structural elements that do not differ from the literal language of the claims, or if they comprise equivalent features or structural elements with insubstantial differences from the literal languages of the claims.

What is claimed is:

1. A cowling for a marine drive, the cowling comprising first and second cowl portions for enclosing a powerhead and a latching device which is movable into a latched position in which the powerhead is enclosed by the first cowl and second cowl portions and an unlatched position in which the second cowl portion is movable with respect to the first cowl portion so that the powerhead is accessible, wherein the latching device comprises an electric actuator configured to automatically move the latching device from the latched position to the unlatched position and a manually-operable input device which is accessible from outside of the cowling and is configured to actuate the electric actuator to thereby automatically move the latching device from the latched position to the unlatched position, wherein the latching device further comprises a pawl mechanism on a first one of the first and second cowl portions and an engagement member on a second one of the first and second cowl portions, the pawl mechanism being movable by the electric actuator into and between a closed position for retaining the engagement member when the latching device is in the latched position and an opened position for releasing and receiving the engagement member when the latching device is in the unlatched position.

2. The cowling according to claim 1, wherein the pawl mechanism comprises first and second pawl members that are rotatable about first and second pawl axes, respectively, the first and second pawl axes being spaced apart from each other.

3. The cowling according to claim 2, wherein the first and second pawl members in the closed position retain the engagement member there between and thus retain the first and second cowl portions together so as to enclose the powerhead, and alternately wherein the first and second pawl members are movable into the opened position so as to release the engagement member and thereby allow the first and second cowl portions to be separated from each other so the powerhead is accessible.

4. The cowling according to claim 3, wherein the pawl mechanism is biased into the opened position.

5. The cowling according to claim 4, further comprising first and second pawl springs that cause the first and second pawl members, respectively, to rotate about the first and second pawl axes so that the pawl mechanism is biased into the opened position.

6. The cowling according to claim 4, wherein the first and second pawl members comprise first and second engagement fingers, respectively, which retain the engagement member in a pocket defined between the first and second pawl members when the pawl mechanism is in the closed position.

7. The cowling according to claim 3, wherein the latching device comprises a trigger member and wherein the electric actuator is configured to move the trigger member out of engagement with the first and second pawl members to thereby permit movement of the pawl mechanism into the opened position.

8. The cowling according to claim 7, wherein disengagement of the trigger member from the first and second pawl members causes the pawl mechanism to automatically move into the opened position.

9. The cowling according to claim 7, wherein the electric actuator is configured to rotate the trigger member, to thereby disengage the trigger member from the first and second pawl members.

10. The cowling according to claim 9, wherein the trigger member is biased into engagement with the first and second pawl members to thereby retain the pawl mechanism in the closed position.

11. The cowling according to claim 7, further comprises a counterweight which balances the trigger member, and which limits unwanted motion when the latch experiences external accelerations from rough water driving and log-strikes.

12. The cowling according to claim 7, further comprising a trigger spring that biases the trigger into engagement with the first and second pawl members.

13. The cowling according to claim 7, wherein the first and second pawl members are rotatable about first and second pawl hubs and further wherein the trigger member is rotatable about a trigger hub, each of the first and second pawl hubs and trigger hub being spaced apart from each other.

14. The cowling according to claim 7, wherein the trigger member comprises an engagement finger, and wherein the first and second pawl members comprise cutout surfaces that engage opposite side surfaces of the engagement finger when the trigger member is engaged with the first and second pawl members.

15. The cowling according to claim 1, further comprising a mounting bracket on the second cowl portion, wherein the engagement member comprises a roller pin on the mounting bracket; and further comprising a latch bracket on the first cowl portion, wherein the electric actuator and pawl mechanism are supported by the latch bracket; and further wherein the pawl mechanism is configured to retain the roller pin when the latching device is in the latched position.

16. A cowling for a marine drive, the cowling comprising first and second cowl portions for enclosing a powerhead and a latching device which is movable into a latched position in which the powerhead is enclosed by the first cowl and second cowl portions and an unlatched position in which the second cowl portion is movable with respect to the first cowl portion so that the powerhead is accessible, wherein the latching device comprises an electric actuator configured to automatically move the latching device from the latched position to the unlatched position and a manually-operable input device which is accessible from outside of the cowling and is configured to actuate the electric actuator to thereby automatically move the latching device from the latched position to the unlatched position, wherein the manually-operable input device comprises a push-button and a printed circuit board, which together are configured such that manually pressing the push-button causes the printed circuit board to actuate the electric actuator, which thereby moves the latching device from the latched position to the unlatched position, and further wherein the printed circuit board is seated in a supporting housing on the cowling and further comprising a potting compound in the supporting housing, the potting compound preventing water ingress to the printed circuit board.

17. The cowling according to claim 16, further comprising an electrical wire that electrically connects the printed circuit board to the electric actuator, wherein the electrical wire extends through the potting compound and is supported with respect to the supporting housing.

18. The cowling according to claim 1, wherein the printed circuit board is configured such that pressing of the push button causes the printed circuit board to actuate the electric actuator only after a time delay.

19. A latching device for latching a cowling on a marine drive, the cowling having first and second cowl portions for enclosing a powerhead, wherein the latching device comprises:

a pawl mechanism on a first one of the first and second cowl portions and an engagement member on a second one of the first and second cowl portions, the pawl mechanism being movable by the electric actuator into and between a closed position for retaining the engagement member when the latching device is in the latched position and an opened position for releasing and receiving the engagement member when the latching device is in the unlatched position;

wherein the pawl mechanism comprises first and second pawl members that are rotatable about first and second pawl axes, respectively;

wherein the first and second pawl members in the closed position retain the engagement member there between and thus retain the first and second cowl portions together so as to enclose the powerhead, and alternately wherein the first and second pawl members are movable into the opened position so as to release the engagement member and thereby allow the first and second cowl portions to be separated from each other so the powerhead is accessible.

20. The latching device according to claim 19, further comprising an electric actuator configured to automatically move the latching device from the latched position to the unlatched position and a manually-operable input device which is accessible from outside of the cowling and is configured to actuate the electric actuator to thereby automatically move the latching device from the latched position to the unlatched position.

21. The latching device according to claim 19, wherein pawl mechanism is biased into the opened position.

22. The latching device according to claim 19, wherein the first and second pawl members comprise first and second engagement fingers, respectively, which retain the engagement member in a pocket defined between the first and second pawl members when the pawl mechanism is in the closed position.

23. The latching device according to claim 19, further comprising a trigger member, and wherein the electric actuator is configured to move the trigger member out of engagement with the first and second pawl members to thereby permit movement of the pawl mechanism into the opened position.

24. The latching device according to claim 23, wherein the first and second pawl members are rotatable about first and second pawl hubs and further wherein the trigger member is rotatable about a trigger hub, each of the first and second pawl hubs and trigger hub being spaced apart from each other.

25. The latching device according to claim 24, wherein the trigger member comprises an engagement finger, and wherein the first and second pawl members comprise cutout surfaces that engage opposite side surfaces of the engagement finger when the trigger member is engaged with the first and second pawl members.

26. The latching device according to claim 19, wherein the manually-operable input device comprises a push-button and a printed circuit board, which together are configured such that manually pressing the push-button causes the printed circuit board to actuate the electric actuator, which thereby moves the latching device from the latched position to the unlatched position.

27. The latching device according to claim 26, further wherein the printed circuit board is seated in a supporting housing on the cowling and further comprising a potting compound in the supporting housing, the potting compound preventing water ingress to the printed circuit board, and further comprising an electrical wire that electrically connects the printed circuit board to the electric actuator, wherein the electrical wire extends through the potting compound and is supported with respect to the supporting housing.

28. The latching device according to claim 26, wherein the printed circuit board is configured such that pressing of the push button causes the printed circuit board to actuate the electric actuator only after a time delay.

* * * * *